US008182221B1

(12) United States Patent
Liang

(10) Patent No.: US 8,182,221 B1
(45) Date of Patent: May 22, 2012

(54) TURBINE BLADE WITH TIP SEALING AND COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 513 days.

(21) Appl. No.: 12/511,205

(22) Filed: Jul. 29, 2009

(51) Int. Cl.
*F01D 5/08* (2006.01)

(52) U.S. Cl. ..... 416/1; 416/97 R; 415/115; 415/173.5; 415/173.4

(58) Field of Classification Search ..... 415/1, 115, 415/173.5, 174.4; 416/1, 90 R, 92, 96 R, 416/97 R
See application file for complete search history.

(56) References Cited

U.S. PATENT DOCUMENTS 6,059,530 A * 5/2000 Lee ..... 416/97 R
6,527,514 B2 * 3/2003 Roeloffs ..... 416/97 R
6,672,829 B1 * 1/2004 Cherry et al. ..... 415/115
6,790,005 B2 * 9/2004 Lee et al. ..... 416/97 R
6,916,150 B2 * 7/2005 Liang ..... 415/115
6,994,514 B2 * 2/2006 Soechting et al. ..... 415/115
7,029,235 B2 * 4/2006 Liang ..... 416/92
7,118,342 B2 * 10/2006 Lee et al. ..... 416/97 R
7,270,514 B2 * 9/2007 Lee ..... 416/92
7,473,073 B1 * 1/2009 Liang ..... 415/173.5
7,494,319 B1 * 2/2009 Liang ..... 416/92
7,740,445 B1 * 6/2010 Liang ..... 415/173.5

* cited by examiner

*Primary Examiner* — Igor Kershteyn
(74) *Attorney, Agent, or Firm* — John Ryznic

(57) ABSTRACT

A turbine rotor blade with a tip region cooling and sealing circuit that includes a squealer tip with a continuous tip rail, the pressure side tip rail being offset from the pressure side wall, the pressure ad suction side tip rails both include concave shaped deflector surfaces on the forward side walls and a row of air jet passages opening onto a top surface of the tip rails, and with radial near wall cooling channels formed within the pressure side and suction side walls to provide near wall cooling, and where the pressure side radial cooling channels supplies the cooling air to the tip rail deflectors to form a vortex flow on the forward side wall of the tip rails, and the suction side radial cooling channels supplies cooling air to the tip rail air jet passages to discharge cooling air to block the on-coming leakage flow across the blade tip. Tip floor cooling passages connect the pressure side radial cooling channels to the suction side deflector surface that alternate with tip floor cooling passages that connect the suction side radial cooling channels to the pressure side tip rail air jet passages.

23 Claims, 11 Drawing Sheets

TURBINE BLADE WITH TIP SEALING AND COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with tip region sealing and cooling.

2. Description of the Related Art Including Information Disclosed Under 37 CFR 1.97 and 1.98

A gas turbine engine, such as an industrial gas turbine (IGT) engine, includes a turbine with multiple rows or stages or stator vanes that guide a high temperature gas flow through adjacent rotors of rotor blades to produce mechanical power and drive a bypass fan, in the case of an aero engine, or an electric generator, in the case of an IGT. In both cases, the turbine is also used to drive the compressor.

Passing a higher temperature gas flow into the turbine referred to as the turbine inlet temperature can increase the efficiency of the gas turbine engine. The highest temperature gas flow is found in the entrance to the first stage stator vanes and rotor blades, since the rotor blades progressively decrease the gas flow temperature as they removed energy from the gas flow stream. Higher temperature resistance materials can be used for these airfoils to allow for higher turbine inlet temperatures. Also, better cooling can be used for these airfoils to allow for use of the same materials but under higher gas flow temperatures. However, the pressurized cooling air used to cool these airfoils is typically bled off from the compressor, which is compressed by work from the engine in which this work is not used to produce power. Thus, using too much cooling air will also reduce the engine performance.

Especially in an industrial gas turbine (IGT) engine, long life for the turbine airfoils is critical, since these engines operate for very long periods of time. Designers and engine operators hope for a constant run time between engine shutdowns of at least 40,000 hours. Since the engine airfoils are exposed to extreme operating conditions, erosion or corrosion are important features that must be addressed in airfoil design. One hot spot occurring on an airfoil can result in the airfoil losing shape or burning a hole in the surface that can cause hot gas injection or too much cooling air to be discharged.

Blade tip region cooling and sealing is an important region to be addressed by a blade designer. Tip cooling is required to prevent hot spots from occurring that can lead to erosion of the blade tip. Limiting the tip leakage flow is required to improved performance of the turbine as well as to reduce an over-temperature on the tip region that would occur due to high amounts of hot temperature gas flowing through the tip clearance. High temperature turbine blade tip section heat load is a function of blade tip leakage flow. A high leakage flow will induce high heat load onto the blade tip section. Therefore, blade tip section sealing and cooling have to be addressed as a single problem. A typical turbine blade tip will include a squealer tip rail that extends around a perimeter of the airfoil flush with the airfoil wall to form an inner squealer pocket. The main purpose of incorporating a squealer tip in a blade design is to reduce the blade tip leakage and also to provide rubbing capability for the blade against an inner shroud surface of the casing. Allowing for slight rubbing will reduce the gap clearance of the blade tip to zero. FIG. 1 shows a prior art turbine rotor blade with a squealer tip cooling design. In general, film cooling holes are built into the blade along the airfoil pressure side tip section and extend from a leading edge to the trailing edge to provide edge cooling for the blade pressure side squealer tip. In addition, convection cooling holes also built into the tip rail at the inner portion of the squealer pocket provide additional cooling for the squealer tip rail. Secondary hot gas flow migration around the blade tip section is also shown in FIG. 2. A vortex flow pattern is formed on the blade suction side as indicated by the vortex flow swirling in FIG. 2.

FIGS. 3 and 4 show a prior art turbine rotor blade with cooling holes for the blade pressure side and suction side tip rails. The blade tip rail is subject to heating from three exposed sides. Cooling of the pressure side and suction side squealer tip rail by means of a discharge row of film cooling holes along the blade peripheral and at the bottom of the squealer floor therefore becomes insufficient. This is primarily due to the combination of tip rail geometry and the interaction of hot gas secondary mixing The effectiveness induced by the airfoil surface film cooling and the tip section convective cooling holes is very limited.

BRIEF SUMMARY OF THE INVENTION

It is an object of the present invention to provide for a blade tip region cooling and sealing design that will significantly reduce or eliminate the above prior art blade tip leakage flow and cooling issues described in the above cited prior art.

It is another object of the present invention to provide for a turbine rotor blade with a near wall cooling configuration and squealer tip cooling arrangement with a passive clearance control design.

These objectives and more can be achieved by the turbine rotor blade with a blade tip construction of the present invention. This unique blade tip configuration is constructed with a double squealer blade tip injection jets from the backside of the pressure side and suction side tip rails. In addition, a double concaved flow deflector is utilized on the up-stream surface of the pressure side and suction side tip rails to resolve these sealing and cooling problems. The pressure side and suction side tip rails are located at an offset position from the airfoil pressure side and suction side walls.

The cooling flow circuit comprises of a series of near wall radial cooling channels on the airfoil pressure side wall coupled with a series of cooling channels across the blade tip section and followed by a series of near wall radial cooling channels on the suction side of the airfoil wall and coupled with a series of cooling channels across the blade tip section. The cooling air is fed from the blade dovetail cavity into multiple series near wall cooling channels through an elbow bend entrance section, flowing through the airfoil pressure and suction side radial channels to provide blade mid-chord region cooling first.

Cooling air exiting from the suction side radial channel impinges onto the backside of the bottom portion of the tip rail floor first. A portion of the spent impingement cooling air is then discharged through the cooling hole built-in the back side of the tip rail for cooling the suction side tip rail as well as provide an impingement jet to seal off the leakage flow. The rest of the spent cooling air is then channeled through the blade squealer tip floor to provide cooling for the blade squealer tip, and then is discharged through the cooling hole built-in the back side of the tip rail for cooling the pressure side tip rail as well as to provide an impingement jet to seal off the leakage flow.

A similar cooling arrangement like the suction side is used for the airfoil pressure side near wall cooling channels, where a portion of the spent cooling air is discharged into the pressure side tip rail deflector for sealing the on-coming leakage flow and also to provide impingement cooling for the pressure side tip rail. The rest of the spent cooling air is then channeled through the blade squealer tip floor to provide cooling for the blade squealer tip, which is then discharged through the $2^{nd}$ deflector built-in the front side of the suction side tip rail for the cooling of the suction side tip rail as well as provide counter flow to seal off the leakage flow. As a result of the cooling flow arrangement of the present invention, an alternative formation for the cooling air discharge through the airfoil pressure side and suction side tip rail is formed that yields a staggered array double cooling and sealing for the blade tip section that provides for a much higher effective sealing for the blade tip section than in the above cited prior art turbine blades.

For the cooling of airfoil leading and trailing edges, cooling air is metered through the partition wall between the mid-chord cooling air supply cavity and cooling air supply cavity at the blade attachment region. Cooling air then flows through the airfoil leading edge to provide showerhead film cooling for the blade leading edge, and a portion of the cooling is also passed through the airfoil trailing edge cooling holes to provide airfoil trailing cooling prior discharge from the airfoil trailing edge.

DETAILED DESCRIPTION OF THE INVENTION

Figure 5:
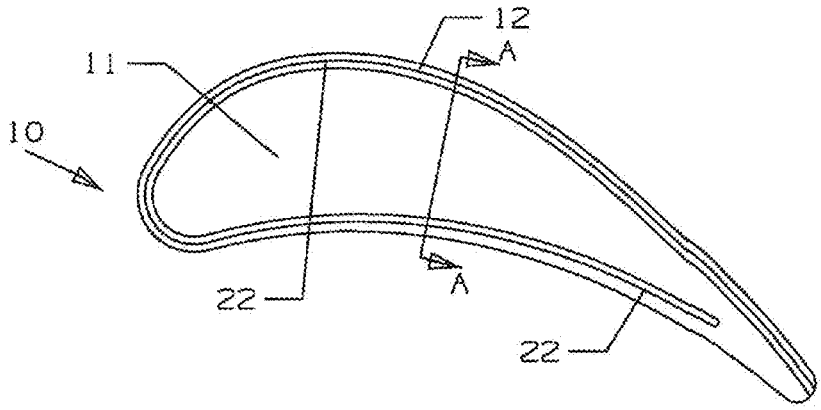
FIG. 5 shows a top view of the rotor blade of the present invention with a double air jet and deflector blade tip cooling and sealing design.

The present invention is a turbine rotor blade with a tip region cooling and sealing design intended for use in an industrial gas turbine (IGT) engine, but can also be used in an aero engine. FIG. 5 shows a top view of the turbine rotor blade 10 of the present invention with a tip floor 11 defined by a tip rail 12 that extends from a trailing edge on the suction side of the blade, around the leading edge and then along the pressure side ending at an opening in the trailing edge region. The tip rail 12 has a pressure side tip rail and a suction side tip rail that is joined together by a leading edge region tip rail to form one continuous tip rail that defines a squealer pocket with the tip floor 11. FIG. 5 shows the deflectors on the P/S tip rail and S/S tip rail that merge into the continuous tip rail in the leading edge region of the airfoil. the deflectors must merge into the tip rail due to the tip rail being a continuous tip rail around the leading edge region of the blade.

Figure 1:
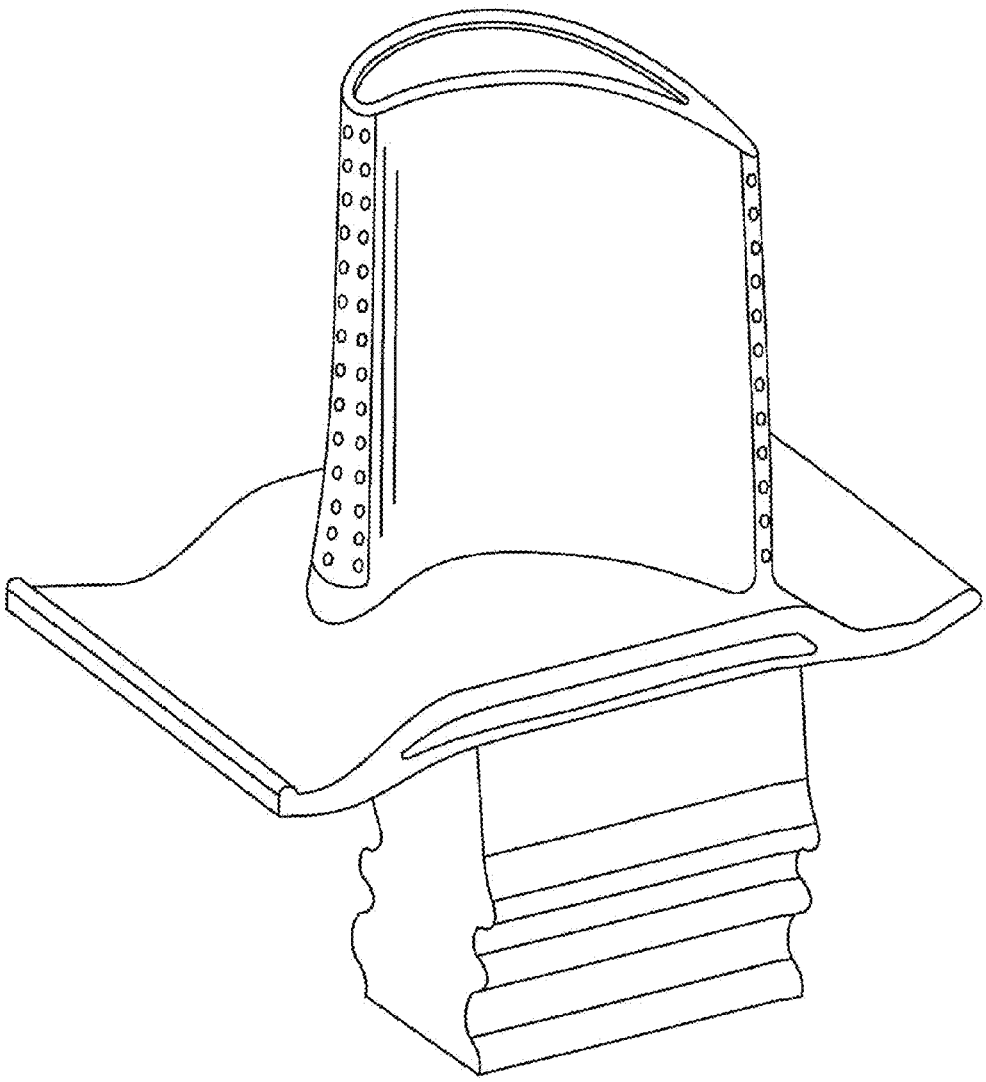
Fig 1 Prior Art
FIG. 1 shows an isometric view of a prior art turbine rotor blade with a squealer tip formed by pressure side and suction side tip rails.
Figure 6:
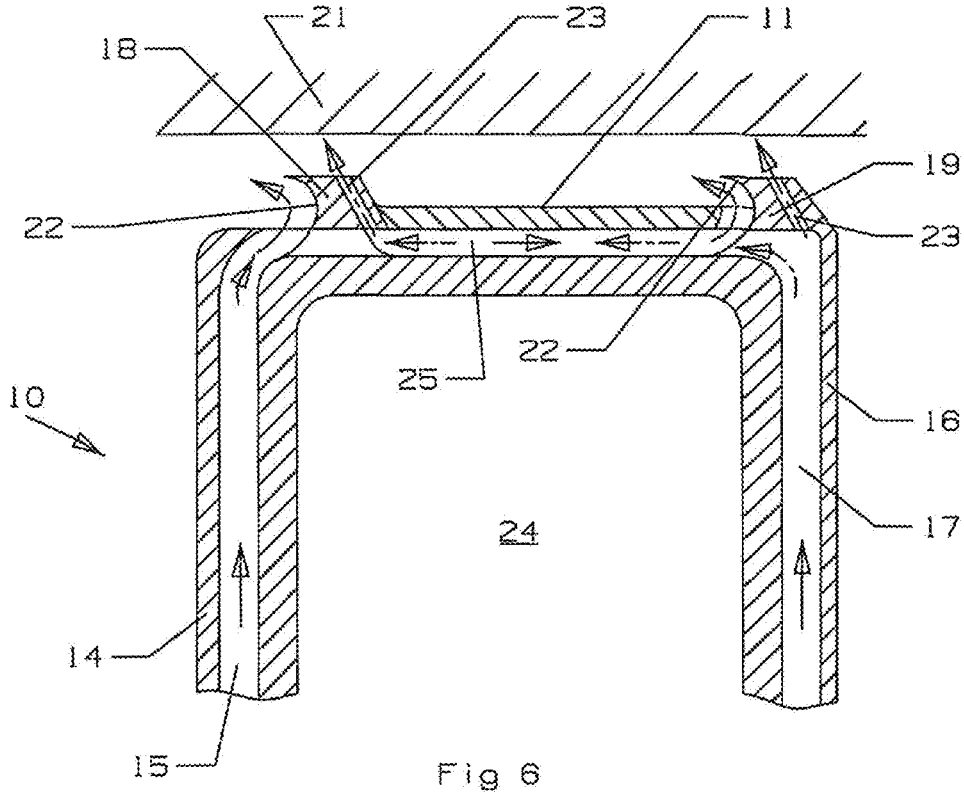
FIG. 6 shows a cross section side view of the rotor blade of the present invention with the radial near wall cooling channels and the tip floor cooling channels and the air jet passages in the tip rails.

FIG. 6 shows a cross section side view through a section of the blade shown by the line A-A in FIG. 1 with the blade 10 having a pressure side wall 14 with a near wall radial cooling channel 15 and a suction side wall 16 with a near wall radial cooling channel 17. The pressure side tip rail 18 includes a flat top surface that forms a gap with a blade outer air seal (BOAS) 21 of the stationary casing of the turbine section. The suction side tip rail 19 also has a flat top surface for the same purpose as the pressure side tip rail 18. Both tip rails 18 and 19 have air jet deflectors 22 that can a concave shape facing the upstream direction of the gas flow. Both tip rails 18 and 19 also contain air jet passages 23 that discharge cooling air from specific radial cooling channels out through the flat top surfaces of the tip rails as described in more detail below. The airfoil includes a cooling air cavity 24 formed between the pressure and suction side walls 14 and 16 and the tip floor 11.

Figure 2:
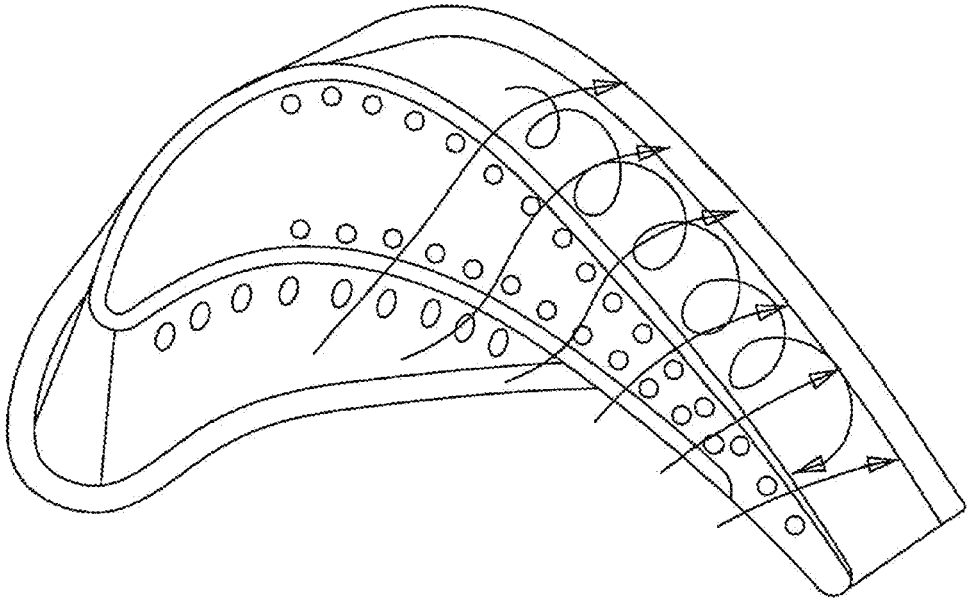
Fig 2 Prior Art
FIG. 2 shows a top view of the prior art blade of FIG. 1 with the secondary flow and cooling pattern represented by the arrows.
Figure 3:
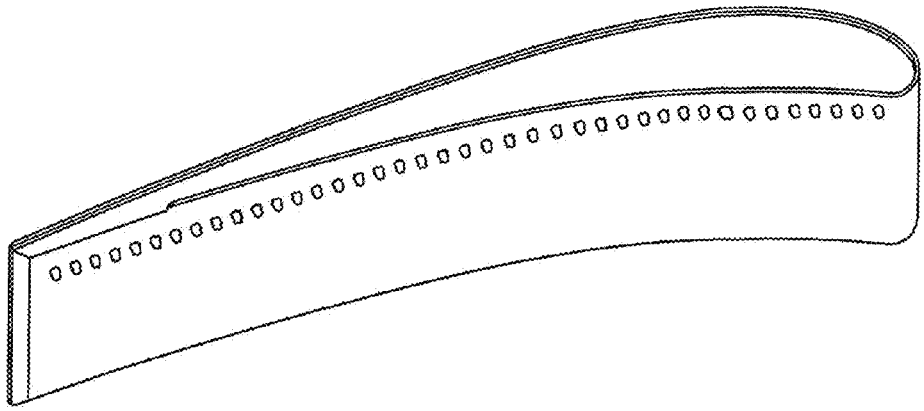
Fig 3 Prior Art
FIG. 3 shows a prior art turbine rotor blade with pressure side tip peripheral film cooling holes extending from the leading edge region to the trailing edge region of the blade tip.
Figure 3:
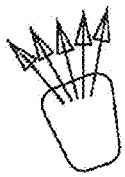
Fig 3 Prior Art
Figure 4:
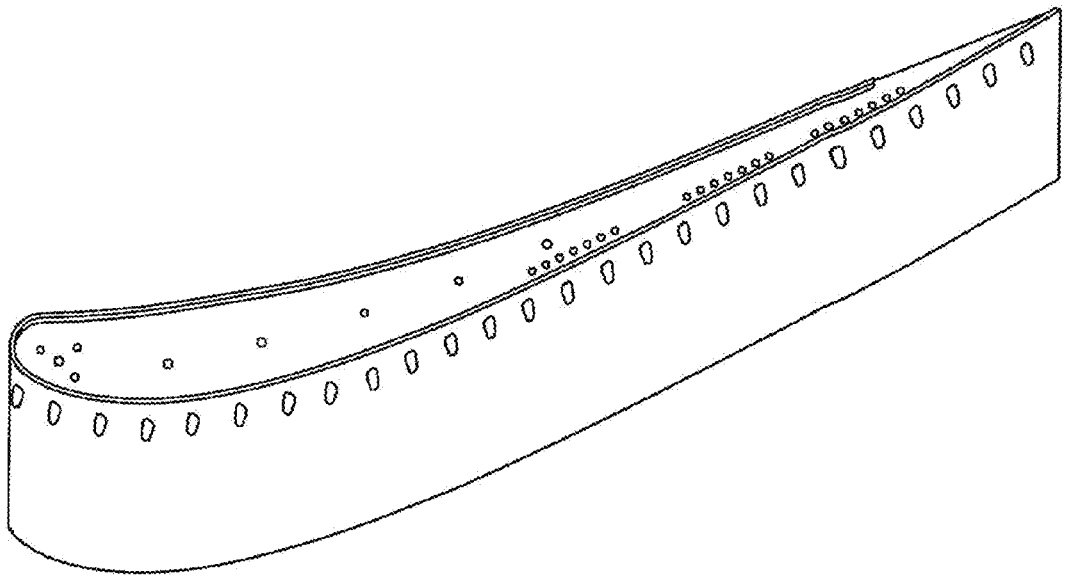
Fig 4 Prior Art
FIG. 4 shows a prior art turbine rotor blade with suction side tip peripheral film cooling holes extending from the leading edge region to the trailing edge region of the blade tip.

Both the pressure side tip rail 18 and the suction side tip rail 19 have aft sides that are slanted toward the forward end of the tip region as seen in FIG. 6. These slightly slanted aft side walls direct the vortex flow (see the swirling vortex flow in FIG. 2 on the suction side tip rail) that forms from the leakage flow back towards the leakage flow in the tip gap to further reduce the leakage flow. The slanted aft side wall of the P/S tip rail 18 will also have a vortex flow pattern developed with the slanted side wall redirecting the vortex flow into the leakage flow to reduce the leakage across the P/S tip rail gap. The pressure side tip rail 18 is offset from the pressure side wall of the airfoil in order that the P/S deflector surface 22 can be formed and so that the P/S deflector can be supplied with cooling air from the P/S radial near wall cooling channels 15 in the P/S wall. The S/S tip rail aft side is slanted but considered to be flush with the S/S airfoil wall because the S/S tip rail is not offset from the S/S airfoil wall.

Figure 7:
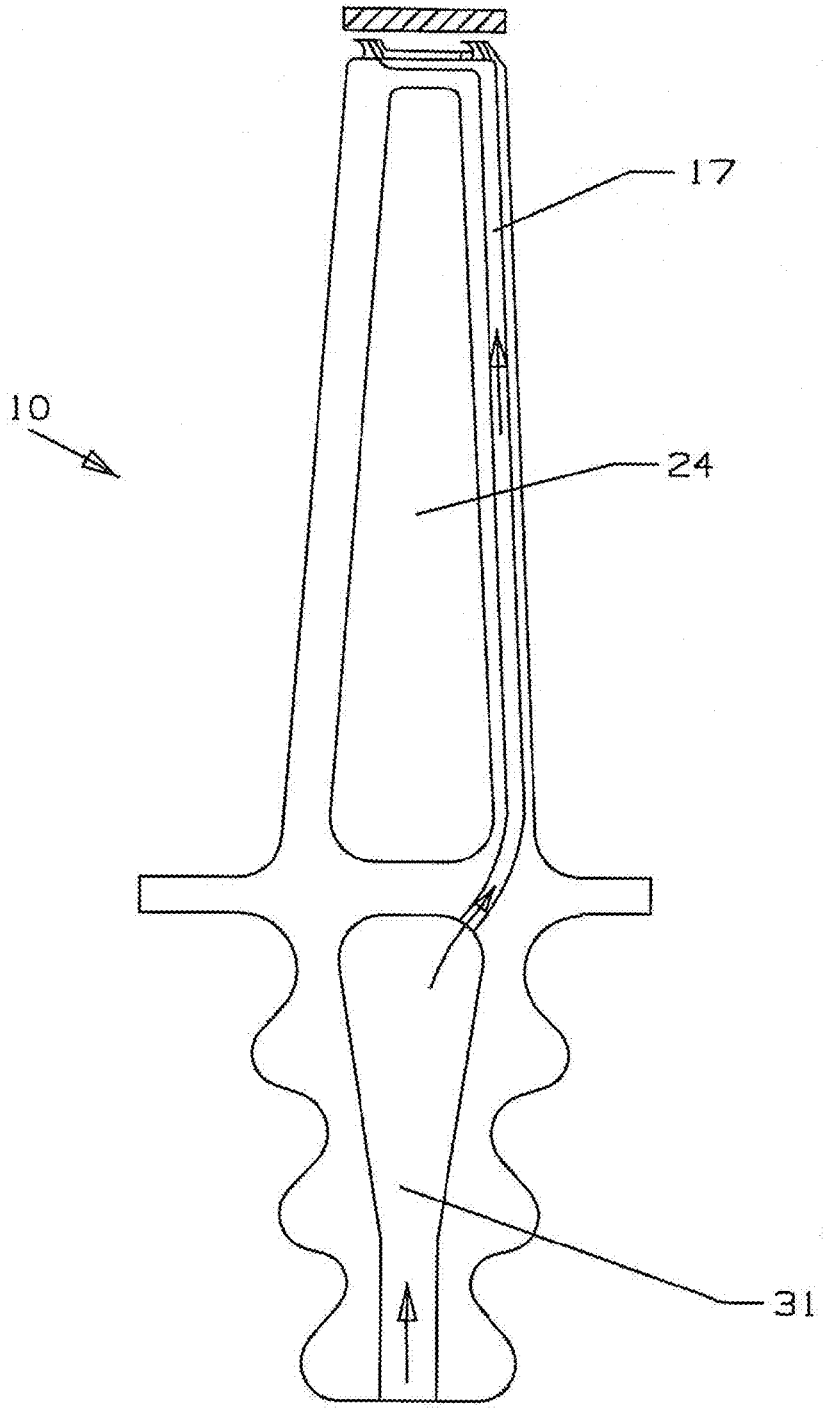
FIG. 7 shows a cross section side view of the rotor blade of the present invention with the suction side wall radial near wall cooling channel from an inlet to an outlet of the blade cooling circuit.
Figure 8:
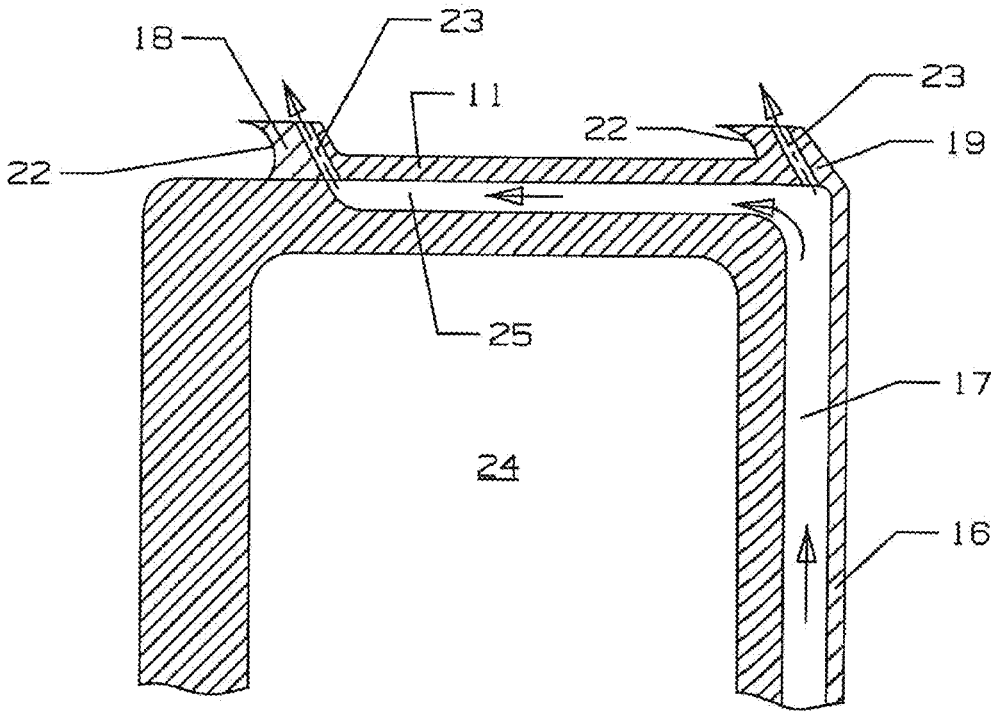
FIG. 8 shows a detailed cross section view of the tip section cooling circuit for the suction side near wall cooling channel of the blade in FIG. 7.

FIG. 7 shows a cross section profile view of the rotor blade 10 with the airfoil section, the tip region, the platform and the root section of the blade. The root section includes an inlet cooling air channel 31 that connects to the radial near wall cooling channels 15 and 17 spaced along the pressure side and suction side walls of the airfoil section. FIG. 7 shows one of the near wall radial cooling channels 17 along the suction side wall connected to the cooling air supply channel 31 in the root and the air jet passages 23 formed in both of the pressure side and suction side tip rails 18 and 19 and well as a tip floor cooling channel 25. In this passage, cooling air supplied from the root section supply channel 31 flows up along the radial channel 17 in the suction side wall with some being diverted into the suction side tip rail air jet passage 23 and the remaining cooling air flowing through the tip floor channel 25 and then out the pressure side tip rail air jet passage 23. FIG. 8 shows a detailed view of this cooling circuit. Cooling air flowing in the suction side near wall radial passage 17 flows upward to the tip region and is separated into suction side tip rail air jet passage 23 and pressure side tip rail air jet passage 23 with the cooling air flowing through the tip floor passage 25 to get to the pressure side tip rail air jet passage 23. This circuit in FIG. 8 alternates with a similar circuit that is shown in FIGS. 9 and 10 described below.

Figure 9:
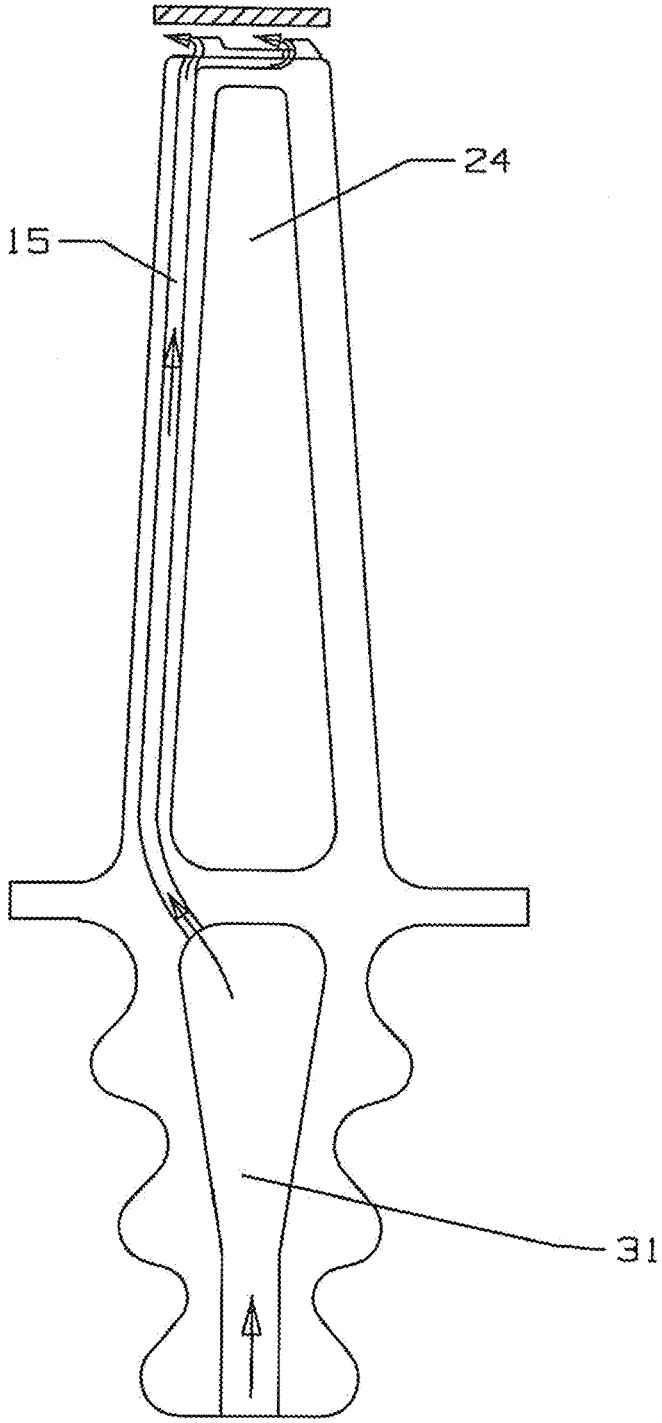
FIG. 9 shows a cross section side view of the rotor blade of the present invention with the pressure side wall radial near wall cooling channel from an inlet to an outlet of the blade cooling circuit.
Figure 10:
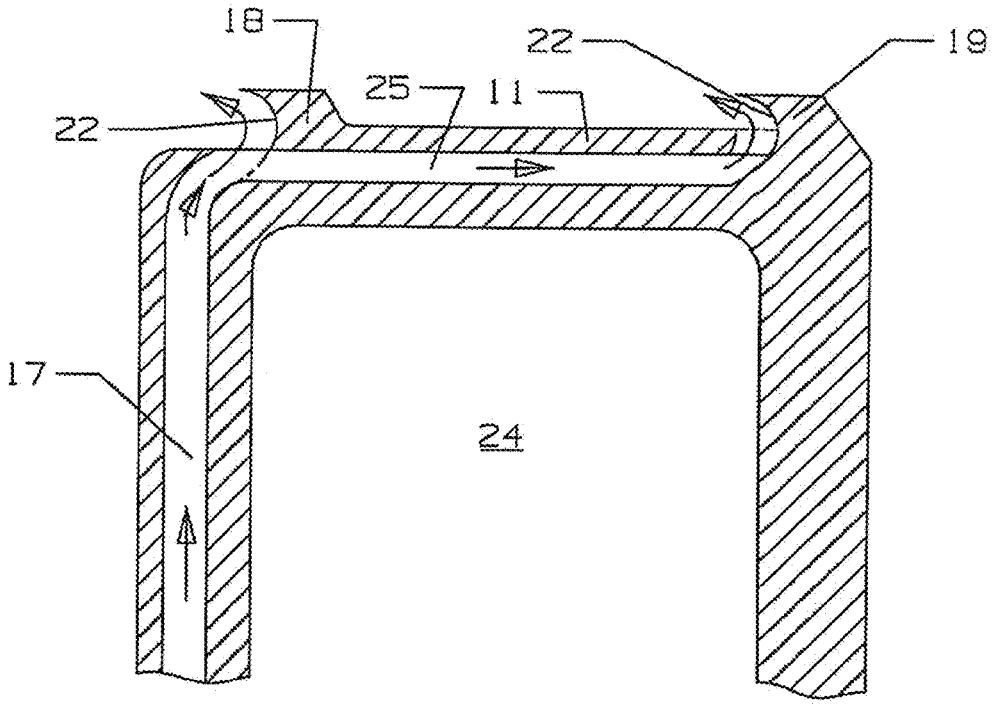
FIG. 10 shows a detailed cross section view of the tip section cooling circuit for the pressure side near wall cooling channel of the blade in FIG. 9.

FIG. 9 shows cross section profile view of the rotor blade 10 with one of the pressure side near wall radial cooling channels 15 that is connected to the root section cooling supply passage 31 on the inlet end, but is connected to the P/S and S/S deflectors 22 instead of the air jet passages 23. Thus, the cooling air flowing through the radial cooling channels 17 on the pressure wall side flows into the concave shaped deflectors 22 formed on the forward or upstream side surface of the tip rails 18 and 19 with the cooling air flowing through the tip floor channel 25 to get to the suction side tip rail deflector 22. The cooling flow passages shown in FIG. 10 alternates with the cooling flow passages shown in FIG. 8 along the airfoil wall in the chord wise direction to form a complete near wall cooling and tip leakage and cooling circuit.

Figure 11:
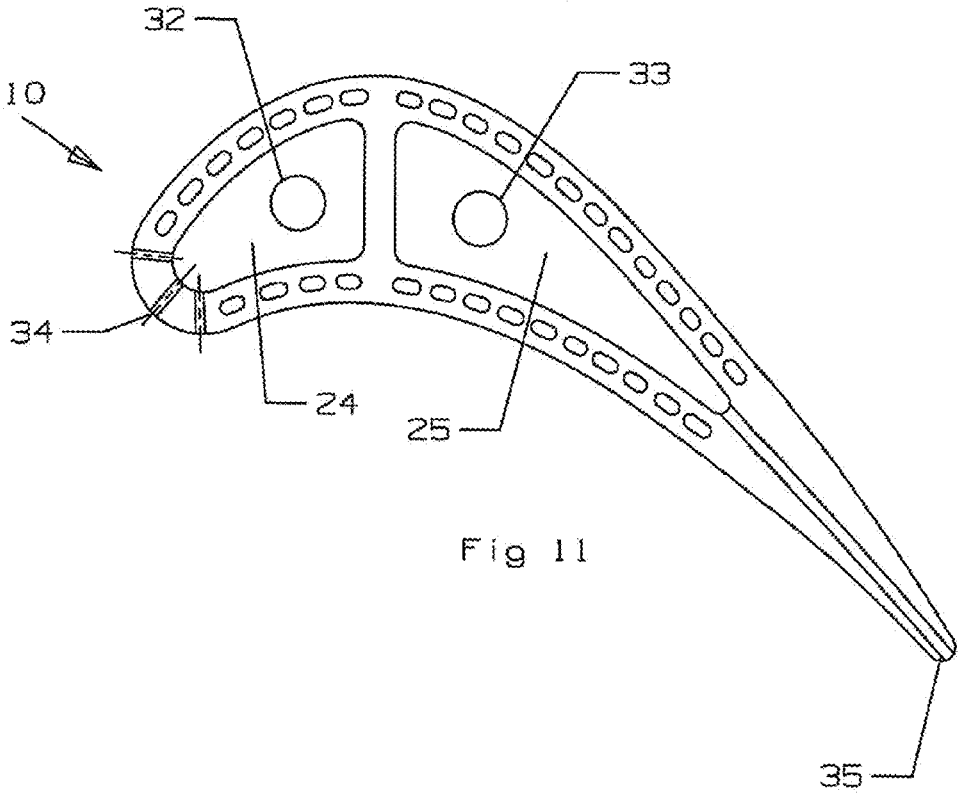
FIG. 11 shows a cross section top view of the airfoil leading edge and trailing edge cooling circuits for the rotor blade of the present invention.
Figure 12:
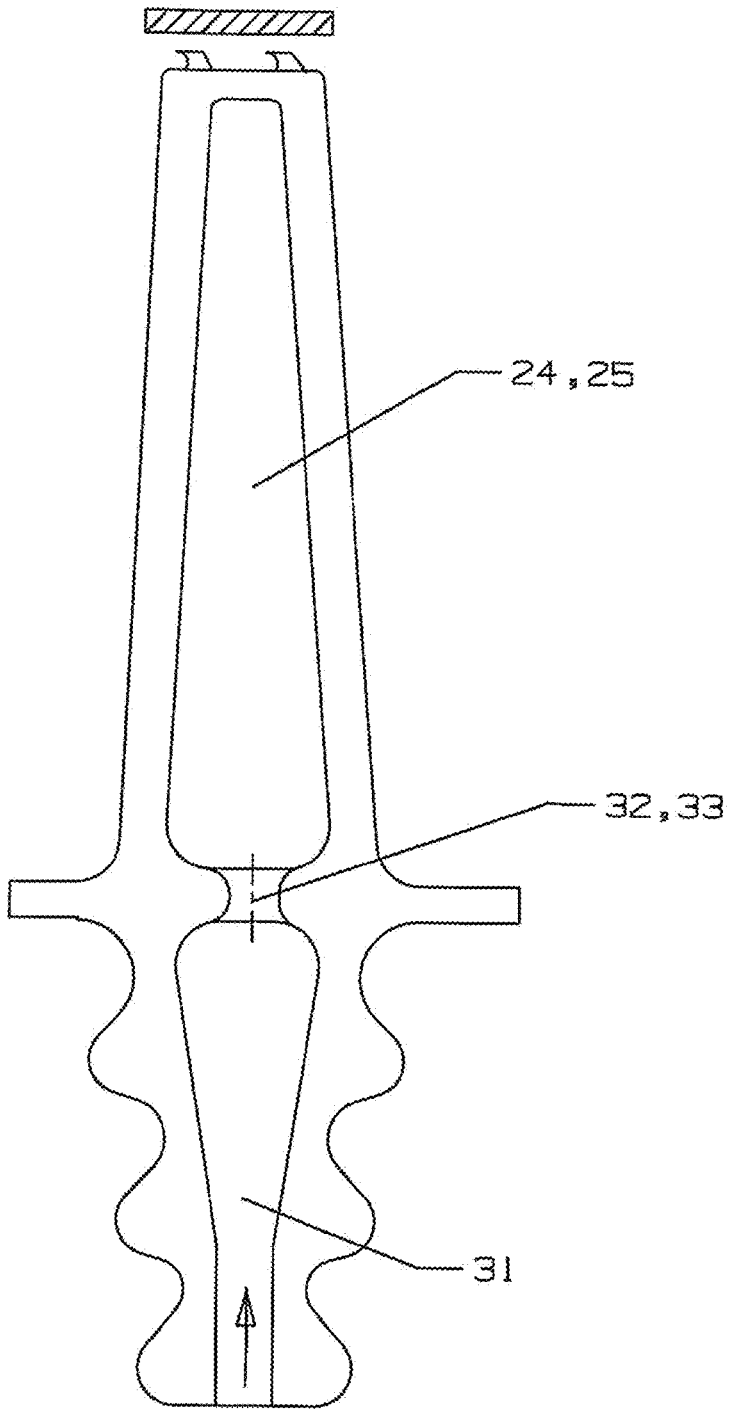
FIG. 12 shows a profile side view of the near wall cooled rotor blade of the present invention.

FIG. 11 shows a cross section top view of the airfoil section of the blade 10 with two cooling supply metering holes 32 and 33 to meter and supply cooling air into a leading edge cavity 24 and a trailing edge cavity 25 separated by a rib extending from the pressure side wall to the suction side wall. The radial near wall cooling passages are formed in the walls of the airfoil. The leading edge cavity 24 is connected to a showerhead arrangement of film cooling holes in the leading edge region of the airfoil. The trailing edge cavity 25 is connected to a row of exit cooling holes or slots 35 formed in the trailing edge region of the airfoil. FIG. 12 shows a cross section profile view of FIG. 11 with the metering holes 32 or 33 connecting the supply channel 31 to the cooling supply cavities 24 or 25. The P/S and S/S tip rails are shown extending from the tip floor.

The entire blade with the root section, airfoil section and blade tip can be cast using the investment casting process along with the radial cooling channels and the tip floor passages. The film cooling holes in the showerhead and the exit holes in the trailing edge and the air jet passages can be drilled after the blade has been cast.

In operation, due to the pressure gradient across the airfoil from the pressure side to the suction side, the secondary flow near the pressure side surface is migrated from lower blade span upward across the blade end tip.

Pressurized cooling air delivered to the root section cooling air supply channel 31 flows into the near wall radial cooling channels 15 and 17 in the pressure side and suction side walls to provide near wall cooling for the airfoil section of the blade along the entire spanwise direction of the airfoil. The cooling air in the suction side wall radial channels 17 flows through the two air jet passages 23 formed in both the pressure side and suction side tip rails 18 and 19, and is ejected as air jets out through the flat top surfaces on the tip rails. The air jet passages 23 are slanted slightly toward the forward side of the tip as seen in FIG. 6. The cooling air flowing into the air jet passage 23 in the pressure side tip rail 23 flows through the tip floor passages 25 to provide convective cooling for the tip floor.

The cooling air in the pressure side radial channels 15 flows out holes on the tip floor 11 and into the concave shaped deflector passages 22 formed on the forward sides of the tip rails 18 and 19, with the cooling air flowing through the tip floor channel 25 to get to the suction side tip rail deflector. Cooling air from the root section supply passage also flows through the two metering holes 32 and 33 and into the L/E cavity 24 and T/E cavity 25, from which the cooling air then flows through the L/E showerhead film cooling holes 34 or the T/E exit slots 35 and out from the blade 10.

On the pressure side corner of the airfoil location, the near wall secondary leakage flow has to flow outward when it enters the pressure side tip rail 18. On the other hand, the spent cooling air discharged from the near wall cooling channels impinged onto the concave flow deflector surface 22 creates a backward splash flow against the on-coming streamwise leakage flow. The interaction of the blade leakage flow with the spent impingement cooling air will push the leakage flow upward by the backward splash cooling flow from the frontal side of the pressure side tip rail prior as it enters the pressure side tip rail 18 squealer channel 23. The backward splash spent impingement cooling air also creates an aerodynamic air curtain to block the leakage flow over the pressure side tip rail 18. In addition to the counter flow action, the concave geometry with acute angle corner for the blade end tip geometry forces the secondary flow to bend outward as the leakage enters the pressure side tip corner and yields a smaller vena contractor and thus reduces the effectiveness leakage flow area. The end result for this combination of effects is a reduced blade leakage flow. Furthermore, the spent convection cooling air from the backside of the tip rail will continue to force the secondary leakage flow outward for the reduction of leakage flow and isolate the blade tip section from hot leakage flow.

Similar leakage flow phenomena on the pressure side tip rail 18 is repeated on the suction side tip rail 19. The creation of these double enhanced tip rail cooling configuration plus leakage flow resistance phenomena by the blade end tip geometry and cooling flow ejection yields a very high resistance for the leakage flow path and thus reduces the blade leakage flow and improve blade tip section cooling. Consequently, it reduces the blade tip section cooling flow requirement.

Major advantages of this sealing and cooling concept over the conventional squealer tip cooling design are enumerated below.

The uniqueness of this blade end tip geometry and cooling air ejection induces a very effective blade cooling and sealing for the blade tip.

Current blade cooling utilizes a series of near wall cooling channels in the blade pressure and suction walls as well as squealer tip to provide convective cooling for the airfoil first then discharge as cooling and sealing for the airfoil. This counter flow and double use of cooling air increase the over all blade cooling effectiveness.

The blade tip rail impingement and elbow turning cooling corresponding to the exit locations of the tip section convection cooling flow channels arrangement which enhance the blade squealer tip rail cooling.

Near wall cooling utilized for the airfoil main body reduces conduction thickness and increases airfoil overall heat transfer convection capability thus reducing airfoil mass average metal temperature.

This cooling concept increases the design flexibility to re-distribute cooling flow and/or add cooling flow for each flow channel thus increasing growth potential for the cooling design.

Each individual cooling channel can be independently designed based on the local heat load and aerodynamic pressure loading conditions.

Lower blade tip section cooling air demand due to lower blade leakage flow.

Higher turbine efficiency due to low blade leakage flow.

Reduction of blade tip section heat load, due to low leakage flow, increases blade usage life.

The built-in cooling air concave cavity for the pressure and suction side tip rail geometry in-lines with the near wall convective cooling channels along the pressure and suction side tip rail forming a impingement cooling pocket which creates high effective heat transfer cooling vortex and trapping the cooling flow longer thus provide better cooling for the tip rail and the blade squealer pocket floor.

The spent impingement cooling air ejected at forward and upward directions relative to the up coming leakage flow. Thus creates an effective mean of leakage flow reduction device.

The acute corner for the forward flowing concave tip rail geometry creates a flow restriction for the in coming leakage flow thus reduce the amount of leakage flow.

I claim the following:

1. A turbine rotor blade comprising:

an airfoil section having a pressure side wall and a suction side wall;

a cooling air cavity formed between the pressure side wall and the suction side wall;

a pressure side tip rail and a suction side tip rail forming a squealer pocket on a tip floor;

the pressure side tip rail being offset from the pressure side wall of the airfoil;

the suction side tip rail includes an aft side wall that is both flush with the suction side airfoil wall and slanted in a direction towards the pressure side wall; and, both the pressure side tip rail and the suction side tip rail includes a flat top surface;

the forward side walls of the pressure side tip rail and the suction side tip rail both include concave shaped deflector surfaces; and, radial cooling channels formed within the pressure side wall of the airfoil and connected to the pressure side and suction side tip rail deflectors to discharge cooling air into the deflectors.

2. A turbine rotor blade comprising:

an airfoil section having a pressure side wall and a suction side wall;

a cooling air cavity formed between the pressure side wall and the suction side wall;

a pressure side tip rail and a suction side tip rail forming a squealer pocket on a tip floor;

the pressure side tip rail being offset from the pressure side wall of the airfoil;

the suction side tip rail includes an aft side wall that is both flush with the suction side airfoil wall and slanted in a direction towards the pressure side wall; and, both the pressure side tip rail and the suction side tip rail includes a flat top surface; and, the pressure side tip rail and the suction side tip rail both include a row of air jet passages opening onto the flat top surfaces of the tip rails and connected to radial cooling channels formed within the suction side wall of the airfoil.

3. The turbine rotor blade of claim 1, and further comprising:

the pressure side wall radial cooling channels are connected to the suction side tip rail deflector through tip floor cooling passages.

4. The turbine rotor blade of claim 2, and further comprising:

the suction side wall radial cooling channels are connected to the pressure side tip rail air jets passages through tip floor cooling passages.

5. The turbine rotor blade of claim 3, and further comprising:

the pressure side tip rail and the suction side tip rail both include a row of air jet passages opening onto the flat top surfaces of the tip rails and connected to radial cooling channels formed within the suction side wall of the airfoil;

the suction side wall radial cooling channels are connected to the pressure side tip rail air jets passages through tip floor cooling passages; and, the tip floor channels that connect the pressure side wall radial channels to the deflectors alternate along the tip floor with the tip floor channels that connect the suction side wall radial channels to the tip rail air jet passages.

6. A turbine rotor blade comprising:

an airfoil section having a pressure side wall and a suction side wall;

a cooling air cavity formed between the pressure side wall and the suction side wall;

a pressure side tip rail and a suction side tip rail forming a squealer pocket on a tip floor;

the pressure side tip rail being offset from the pressure side wall of the airfoil;

the suction side tip rail includes an aft side wall that is both flush with the suction side airfoil wall and slanted in a direction towards the pressure side wall; and, both the pressure side tip rail and the suction side tip rail includes a flat top surface;

a cooling air supply cavity formed between the pressure side wall and the suction side wall of the airfoil;

a metering hole to connect a cooling air inlet cavity formed within a root section of the blade to the cooling air supply cavity; and, the cooling air supply cavity is not fluidly connected to radial cooling channels or tip floor cooling channels.

7. The turbine rotor blade of claim 6, and further comprising:

the cooling air supply cavity is located in a leading edge region of the airfoil; and, a showerhead arrangement of film cooling holes is connected to the leading edge cooling air supply cavity.

8. The turbine rotor blade of claim 6, and further comprising:

the cooling air supply cavity is located in a trailing edge region of the airfoil; and, a row of exit cooling holes located in the trailing edge region of the airfoil is connected to the trailing edge cooling air supply cavity.

9. A turbine rotor blade comprising:

an airfoil section having a pressure side wall and a suction side wall;

a cooling air cavity formed between the pressure side wall and the suction side wall;

a pressure side tip rail and a suction side tip rail forming a squealer pocket on a tip floor;

the pressure side tip rail and the suction side tip rail both include a concave shaped deflector on a forward side wall of the tip rail;

the pressure side tip rail and the suction side tip rail both include a row of air jet passages opening onto a top surface of the tip rail; and, the deflectors and the air jet passages being connected to a cooling air passage within the airfoil such that cooling air is discharged into the deflectors and out from the air jet passages.

10. The turbine rotor blade of claim 9, and further comprising:

the tip rail deflectors are connected to a plurality of pressure side wall radial cooling channels; and, the tip rail air jet passages are connected to a plurality of suction side radial wall cooling channels.

11. The turbine rotor blade of claim 9, and further comprising:

the tip rail is a continuous tip rail around the leading edge;

the pressure side tip rail is offset from the pressure side wall of the airfoil; and, the pressure side tip rail and the suction side tip rail both have aft side walls that slant toward the pressure side wall.

12. The turbine rotor blade of claim 9, and further comprising:

the air jet passages in both tip rails are slanted toward the pressure side wall.

13. The turbine rotor blade of claim 10, and further comprising:

the suction side tip rail deflector is connected to the plurality of pressure side wall radial cooling channels through a plurality of tip floor cooling channels; and, the pressure side tip rail air jet passages are connected to the plurality of suction side wall radial cooling channels through a plurality of tip floor cooling channels.

14. A turbine rotor blade comprising:

an airfoil section with a pressure side wall and a suction side wall;

a cooling air cavity formed between the two side walls;

a plurality of pressure side radial near wall cooling passages formed within the pressure side wall of the airfoil;

a plurality of suction side radial near wall cooling passages formed within the suction side wall of the airfoil;

a tip floor having a plurality of tip floor cooling channels connected to the pressure side radial cooling channels;

the tip floor having a plurality of tip floor cooling channels connected to the suction side radial cooling channels; and, the pressure side tip floor cooling channels and the suction side tip floor cooling channels alternating along the tip floor.

15. The turbine rotor blade of claim 14, and further comprising:

a pressure side tip rail offset from a pressure side wall of the airfoil;

a suction side tip rail; and, an aft side wall of both tip rails being slanted toward the pressure side wall.

16. The turbine rotor blade of claim 14, and further comprising:

a pressure side tip rail offset from a pressure side wall of the airfoil;

a suction side tip rail; and, the pressure side tip rail and the suction side tip rail both include a concave shaped deflector on a forward side wall of the tip rail.

17. The turbine rotor blade of claim 14, and further comprising:

a pressure side tip rail offset from a pressure side wall of the airfoil;

a suction side tip rail; and, the pressure side tip rail and the suction side tip rail both include a row of air jet passages opening onto a top surface of the tip rail.

18. A process for cooling and sealing a tip region of a turbine rotor blade, the turbine rotor blade includes an airfoil section with a pressure side wall and a suction side wall with a cooling air cavity formed between the two side walls, the turbine rotor blade also includes a continuous tip rail with a pressure side tip rail offset from the pressure side wall and a suction side tip rail flush with the suction side wall, the process comprising the steps of:

passing cooling air through the pressure side wall to produce near wall cooling of the pressure side wall;

passing cooling air through the suction side wall to produce near wall cooling of the suction side wall;

discharging the cooling air from the pressure side wall cooling on a forward side wall of the pressure side and suction side tip rails to form a vortex flow of cooling air; and, discharging the cooling air from the suction side wall cooling out through the tip rails to produce air jets to block on-coming leakage flow across the blade tip.

19. The process for cooling and sealing a tip region of a turbine rotor blade of claim 18, and further comprising the step of:

passing the cooling air to the suction side tip rail vortex flow through the tip floor to provide cooling for the tip floor.

20. The process for cooling and sealing a tip region of a turbine rotor blade of claim 19, and further comprising the step of:

alternating passing the cooling air to the pressure side tip rail air jets through the tip floor with the passing of the cooling air from the suction side tip rail vortex flow to provide cooling for the tip floor.

21. The process for cooling and sealing a tip region of a turbine rotor blade of claim 18, and further comprising the step of:

passing the cooling air to the pressure side tip rail air jets through the tip floor to provide cooling for the tip floor.

22. The process for cooling and sealing a tip region of a turbine rotor blade of claim 18, and further comprising the steps of:

metering cooling air into a cooling supply cavity formed between the pressure side wall and the suction side wall; and, discharging a layer of film cooling air onto the leading edge region of the airfoil from the cooling supply cavity.

23. The process for cooling and sealing a tip region of a turbine rotor blade of claim 18, and further comprising the steps of:

metering cooling air into a cooling supply cavity formed between the pressure side wall and the suction side wall; and, cooling the trailing edge region of the airfoil with the cooling air from the cooling supply cavity.

* * * * *